US006668837B1

(12) United States Patent
Heitmann

(10) Patent No.: US 6,668,837 B1
(45) Date of Patent: Dec. 30, 2003

(54) ARRANGEMENT FOR REDUCING THE NOISE LEVEL OF TOBACCO-PROCESSING PRODUCTION MACHINES

(75) Inventor: Uwe Heitmann, Hamburg (DE)

(73) Assignee: Hauni Maschinenbau AG, Hamburg (DE)

( * ) Notice: Subject to any disclaimer, the term of this patent is extended or adjusted under 35 U.S.C. 154(b) by 191 days.

(21) Appl. No.: 09/657,812

(22) Filed: Sep. 8, 2000

(30) Foreign Application Priority Data

Sep. 10, 1999 (DE) ..... 199 43 320

(51) Int. Cl.[7] ..... A24C 5/00
(52) U.S. Cl. ..... 131/280; 131/28
(58) Field of Search ..... 131/280, 28, 200, 131/203, 208

(56) References Cited

U.S. PATENT DOCUMENTS

| | | | | |
|---|---|---|---|---|
| 3,412,513 A | * | 11/1968 | Gösele | 181/290 |
| 3,518,911 A | * | 7/1970 | Niemann et al. | 83/329 |
| 3,866,708 A | | 2/1975 | Rudszinat et al. | |
| 4,372,710 A | | 2/1983 | Kasparek et al. | |
| 4,555,433 A | * | 11/1985 | Jablonka et al. | 181/284 |
| 5,888,610 A | * | 3/1999 | Fournier et al. | 156/292 |
| 5,975,238 A | * | 11/1999 | Fuchs et al. | 181/286 |

FOREIGN PATENT DOCUMENTS

| | | | |
|---|---|---|---|
| DE | 2758041 | * | 6/1979 |
| DE | 29 10 371 | | 10/1980 |
| DE | 29 29 406 | | 2/1981 |
| DE | 31 03 060 | | 12/1981 |
| DE | 32 33 654 C2 | | 3/1984 |
| DE | 35 24 022 A1 | | 1/1987 |
| DE | 36 38 797 C2 | | 5/1987 |
| DE | 37 13 780 A1 | | 11/1987 |
| DE | 39 31 228 A1 | | 3/1990 |
| DE | 39 13 255 A1 | | 10/1990 |
| DE | 9116 233.6 | | 7/1992 |
| GB | 1 442 751 | | 7/1976 |
| GB | 2 068 875 | | 8/1981 |
| WO | 97/16365 | | 5/1997 |
| WO | 99/22611 | | 5/1999 |

OTHER PUBLICATIONS

"Conveyor System", Research Disclosure, GB, Industrial Opportunities Ltd., Havant, Oct. 1996, pp. 671–672, XP 000639939.

U.S. patent application Ser. No. 09/650,741, Heitmann.

* cited by examiner

*Primary Examiner*—James Derrington
*Assistant Examiner*—Carlos Lopez
(74) *Attorney, Agent, or Firm*—Venable LLP; Robert Kinberg; Chad C. Anderson

(57) ABSTRACT

In an arrangement for reducing noise level in a tobacco-processing production machine having an operator region and reflection surfaces facing the operator region, sound-damping material is disposed on the reflection surfaces facing the operator region.

22 Claims, 10 Drawing Sheets

ARRANGEMENT FOR REDUCING THE NOISE LEVEL OF TOBACCO-PROCESSING PRODUCTION MACHINES

CROSS-REFERENCE TO RELATED APPLICATIONS

Priority is claimed with respect to Application No. 199 43 320.8 filed in the German Patent Office on Sep. 10, 1999, the disclosure of which is incorporated herein by reference.

BACKGROUND OF THE INVENTION

The invention relates to an arrangement for reducing the noise level of tobacco-processing production machines, particularly in an operator region of a production line comprising at least two production machines disposed at an angle to one another.

Production machines of the tobacco-processing industry primarily encompass cigarette-production machines and filter-attachment machines, which are preferably joined diagonally at a 90° angle to form a production line. The machines may further include packaging machines and other standard tobacco-industry components, such as filter-production machines and article-transport devices, the latter representing a secondary source of noise. Particularly in the aforementioned production line, an operator, who is preferably positioned in the corner zone between two machines, is exposed to a great deal of machine noise. Previous efforts to reduce the noise have been unsuccessful in preventing operating noises created by mechanical components, and flow noises produced by process air, especially suction noises, from being emitted from the machines and entering the operator region, because it is not possible to hermetically seal the machine.

SUMMARY OF THE INVENTION

It is an object of the invention to implement further, more effective anti-noise measures.

In accordance with the invention, this object is accomplished in that the reflection surfaces facing the operator region are provided with sound-damping material.

According to a modification, a particularly effective noise absorption is attained when the sound-damping structure of the damping material faces the operator region. This is realized particularly simply if the reflection surfaces formed by the cladding of the production machines are equipped with damping mats.

An embodiment that is especially easy to handle, exchange and adapt involves a configuration of damping mats as exchangeable damping elements having a neutral shape.

The damping elements are advantageously embodied as truncated cones that are connected to the machine cladding by a central screw connection.

In an advantageous embodiment, in which the absorption properties are guaranteed, and, at the same time, an attractive appearance is assured, the absorption surfaces of the truncated cones are covered with cladding sheets having openings in the manner of a sieve.

In a preferred embodiment of the absorption surfaces as parts of a removable carriage, the damping mats are inserted between inside reflection plates and outside, sieve-like cladding surfaces, with the reflection plates and cladding sheets additionally being inserted into corner-profile strips whose hollow space is filled with damping material. This achieves a machine cladding that has a smooth surface and effective absorption properties.

In the sense of a unified, sound-absorbing machine cladding, it is also provided that, in an absorption surface embodied as a door, inside and outside cladding sheets are inserted, with an interposed reflection surface and hollow spaces filled with damping mats, into a profile frame embodied as a hollow body and closed by corner connectors, the frame being provided with a pivoting axis and recessed sealing elements. To increase the stability of such an arrangement, it is also proposed that the cladding sheets and the reflection surface be stabilized by means of spacing sleeves that are screwed together.

The versatility of the construction principle exhibited by the cited arrangements is expanded in a modification in which two viewing panes are inserted into a profile strip in an absorption surface embodied as a window flap, with the strip and an inserted cladding sheet limiting a hollow space filled with damping mats.

For the anti-noise measures to include a relatively large base surface that reflects the machine noises, it is further proposed for at least one standing region for the operating personnel, which borders the production line of the machines, be provided with a damping layer. This type of arrangement can be embodied to be particularly effective and easy to handle if, in accordance with a modification, the damping layer comprises damping tiles laid under the entire surface of the production machines.

This type of arrangement becomes especially stable and effective in terms of damping if the damping tiles are embodied as tile boxes filled with damping material and disposed in the manner of a grid between supports. The boxes are easily accessible, without losing their absorption properties, because they are provided with a gridiron support that forms a standing surface.

With the arrangement under the entire surface of the machines, a high contact stability must be present beneath the machine feet, which is achieved by the insertion of damping tiles having stress-specific layers into the gridiron support.

To facilitate the sweeping of these gridiron supports, and to prevent tobacco fibers from entering the damping material through the grid openings, a preferred modification provides that a tile box forming a floor tile has a gridiron that includes elevations, as well as lateral and base-side buffers, which avoids a direct contact between adjacent tile boxes, and between tile boxes and the floor, that would effect a solid-borne sound transmission.

The penetration of tobacco fibers or other undesired elements, or moisture, into the damping materials is prevented by a preferred embodiment, in which the gridiron support of a tile box has rounded edges and is positioned on a sound-permeable film, which covers a fine-mesh sieve lying on the damping mat.

To complete the anti-noise measures, it is further provided that the air-flow cross sections required for the process air supply of the production machines are predominantly concentrated in flow conduits clad with sound-damping material.

In connection with the damping mats covering the floor, a further proposal allows flow-related noise sources to be controlled by the concentration of sound-damped flow conduits in the floor region of the production machines.

The flow noises are additionally reduced by the embodiment of air-passage gaps of the machine cladding as sound-absorbing damping gaps.

The advantage attained with the invention is that, regardless of specific, particularly sound-intensive, noise sources inside the machines and the more or less successful isolation of the noises from the outer operator region of the machines, the entire sound spectrum is generally reduced, because the operating noises emitted by the machines, which have different frequencies, are absorbed outside of the machine interiors, and are therefore considerably reduced with respect to the operating personnel.

BRIEF DESCRIPTION OF THE DRAWINGS

The invention is described in detail below in conjunction with embodiments illustrated in the drawing.

Shown are in.

DETAILED DESCRIPTION OF THE INVENTION

Figure 1:
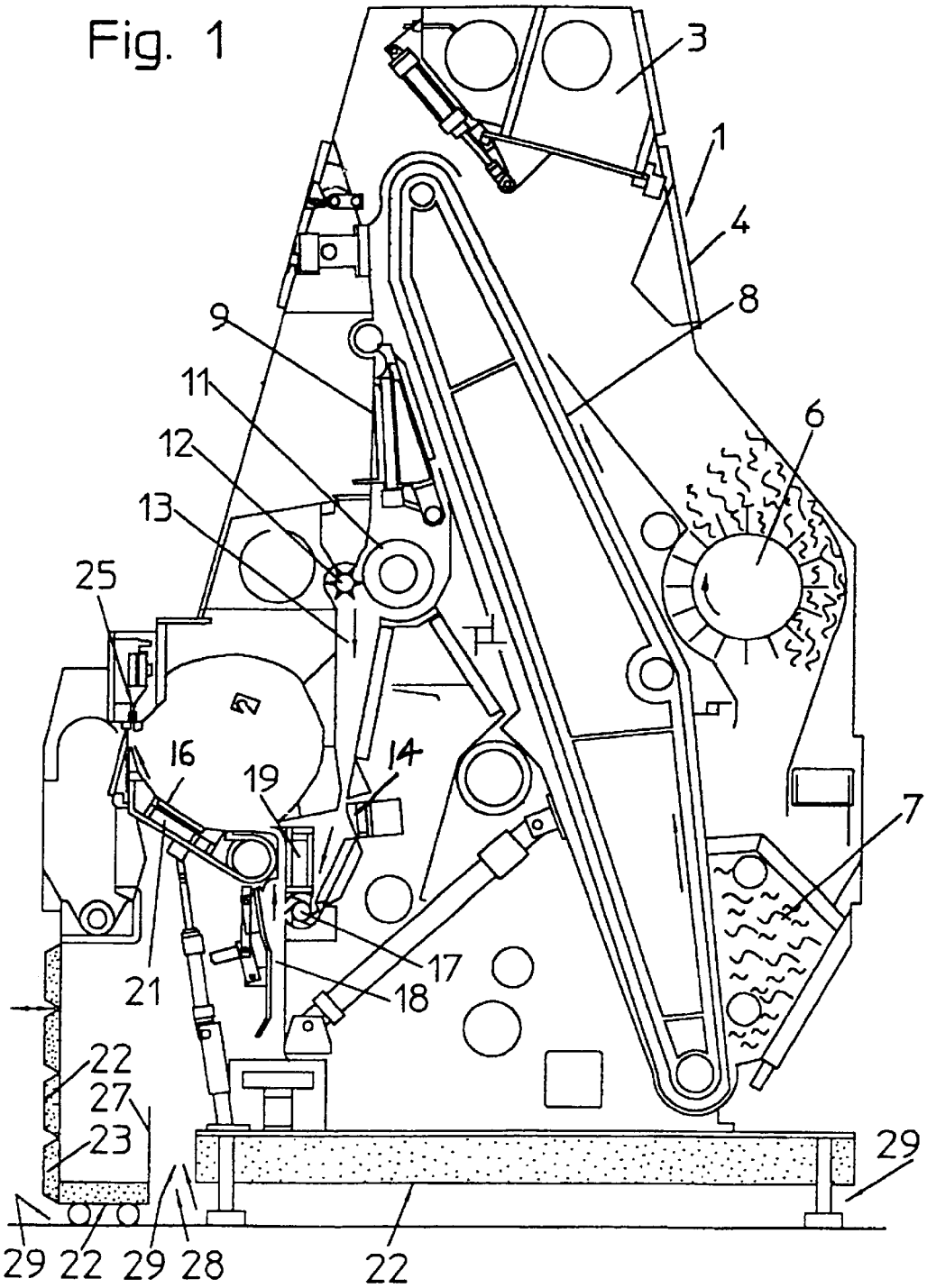
FIG. 1 is a sectional representation through the distributor of a cigarette-strand machine.
Figure 3:
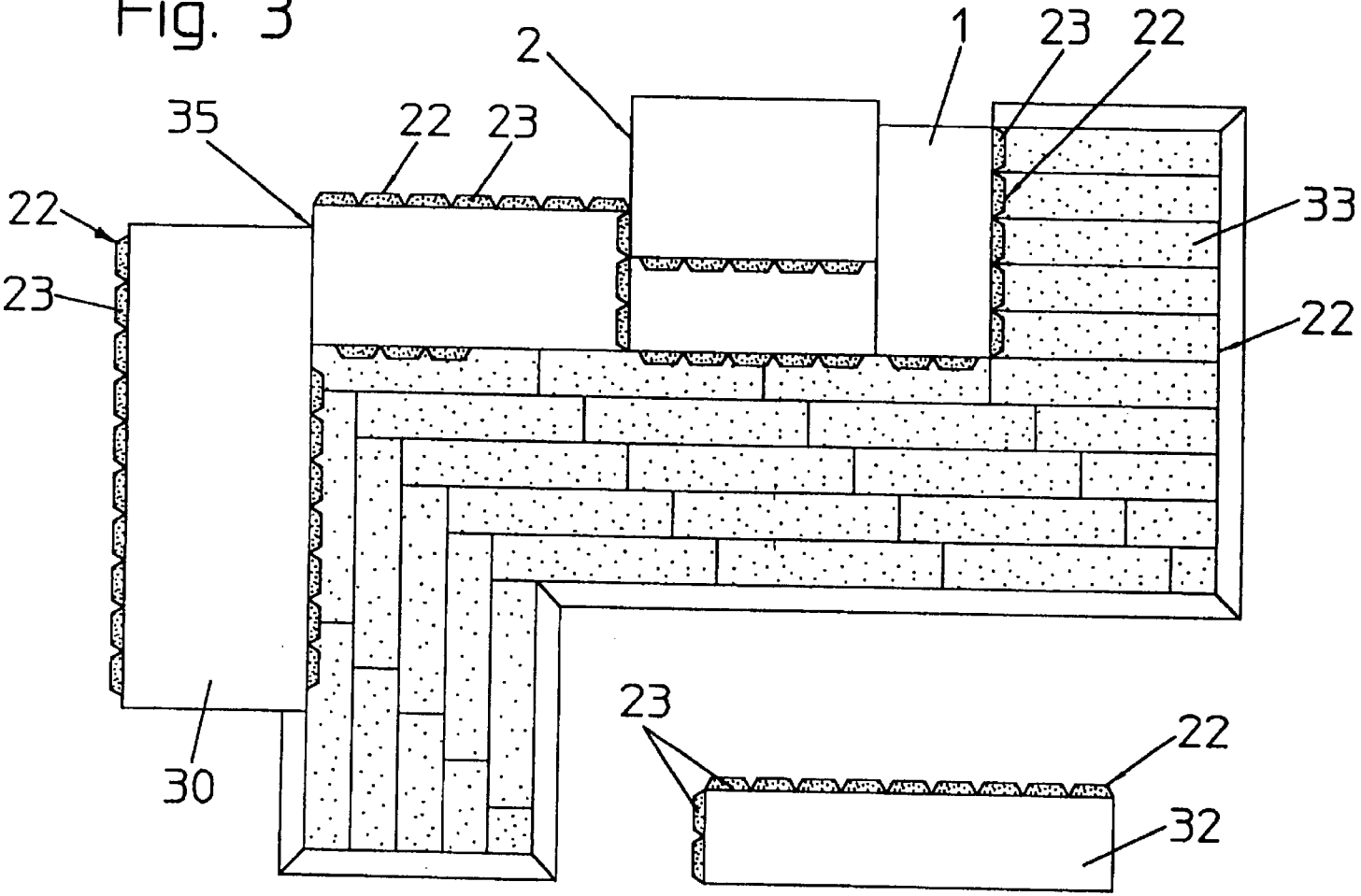
FIG. 3 is a plan view of an angular production line formed by a cigarette machine and a filter-attachment machine.

The distributor 1 illustrated in FIG. 1 is an aggregate of the cigarette-strand machine 2 according to FIG. 3, with a high throughput of flowing process air for the purpose of feeding and sorting tobacco and forming a tobacco strand from a stream of tobacco. The tobacco is fed in portions, via a pneumatic lock system 3, into a reservoir container 4 of distributor 1, transferred via a screen roller 6 into an intermediate storage element 7, then transported upward by a removal conveyor 8 equipped with carriers, and placed in a storage shaft 9, whose fullness level is kept essentially constant.

A removal roller 11 continuously removes tobacco from storage shaft 9 and, in cooperation with a beater roller 12, transfers it into a drop shaft 13.

At the lower exit of the drop shaft 13, a transverse sorting air current generated by high-pressure air nozzles 14 separates the tobacco into heavier and lighter tobacco fibers, of which the latter are transported to a concave guiding surface 16, while the former travel downward via a star-feeder lock 17 into a sorting shaft 18, from which heavy strands are removed at the bottom after a further sorting, and lighter tobacco fibers are transported upward due to the injector effect of a compressed-air jet generated by a further nozzle arrangement 19, then join the other tobacco fibers on the guide surface 16 to form a tobacco stream that extends over the width of the distributor 1 (perpendicular to the drawing plane), which is supported and accelerated by additional compressed air exiting a further nozzle arrangement 21 at the guide surface 16.

In this way, the tobacco stream is transferred upward to a suction strand conveyor 25 that is moved perpendicular to the drawing plane, and at which a tobacco strand is formed with the use of flowing suction air; this strand is encased and processed into individual cigarettes as it continues through the cigarette-strand machine 2.

The high air throughput effected by the numerous pneumatic conveyor elements creates an increased noise level in addition to the mechanical drive noises of the machine. This noise reaches the outside by way of unavoidable machine cladding gaps.

Figure 7:
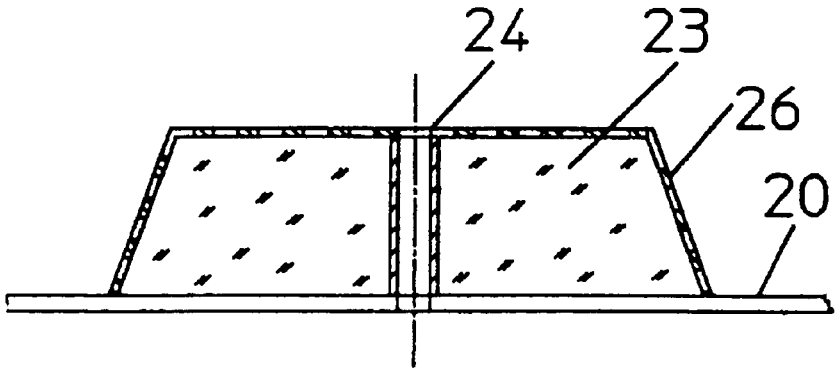
FIG. 7 a cross section through a sound-damping element of the machine cladding.
Figure 8:
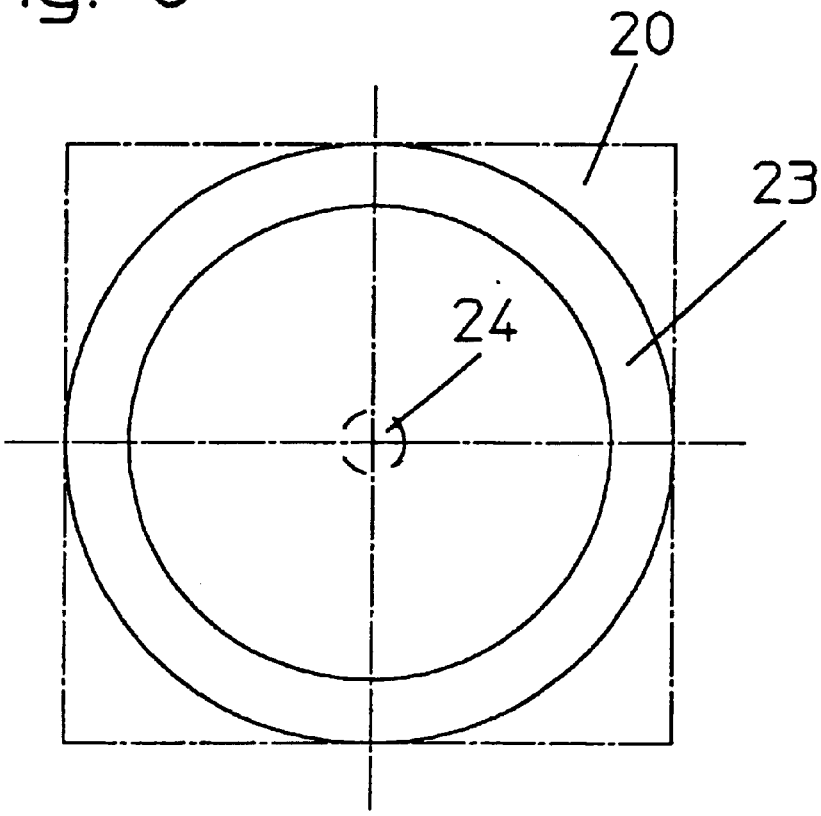
FIG. 8 a plan view of the sound-damping element according to FIG. 7.

In accordance with the invention, the outside machine walls, flaps, doors, hoods or carriages facing the operating space or the floor region, and acting as reflection surfaces 20, are provided to the greatest possible extent with noise-damping material in the form of damping mats 22, which are embodied with a neutral shape, such as frustoconical damping elements 23, in the region of the outside machine walls according to FIG. 7, and are connected by a central screw connection 24 to the machine cladding sheets of varying sizes so as to be easily exchanged.

According to FIG. 7, the damping elements 23 facing the operating space with their sound-damping structure are covered on all absorption surfaces with sound-permeable cladding sheets 26, which are provided with holes in the manner of a sieve.

The damping mats 22 on the machine floor are embodied to limit an air-intake opening 27 of sufficiently-large dimensions, and act as sound dampers 28 on the air 29 flowing in. In this way, the supply of process air is predominantly concentrated over the machine floor, instead of being conveyed via gaps in the front or rear machine cladding.

Figure 2:
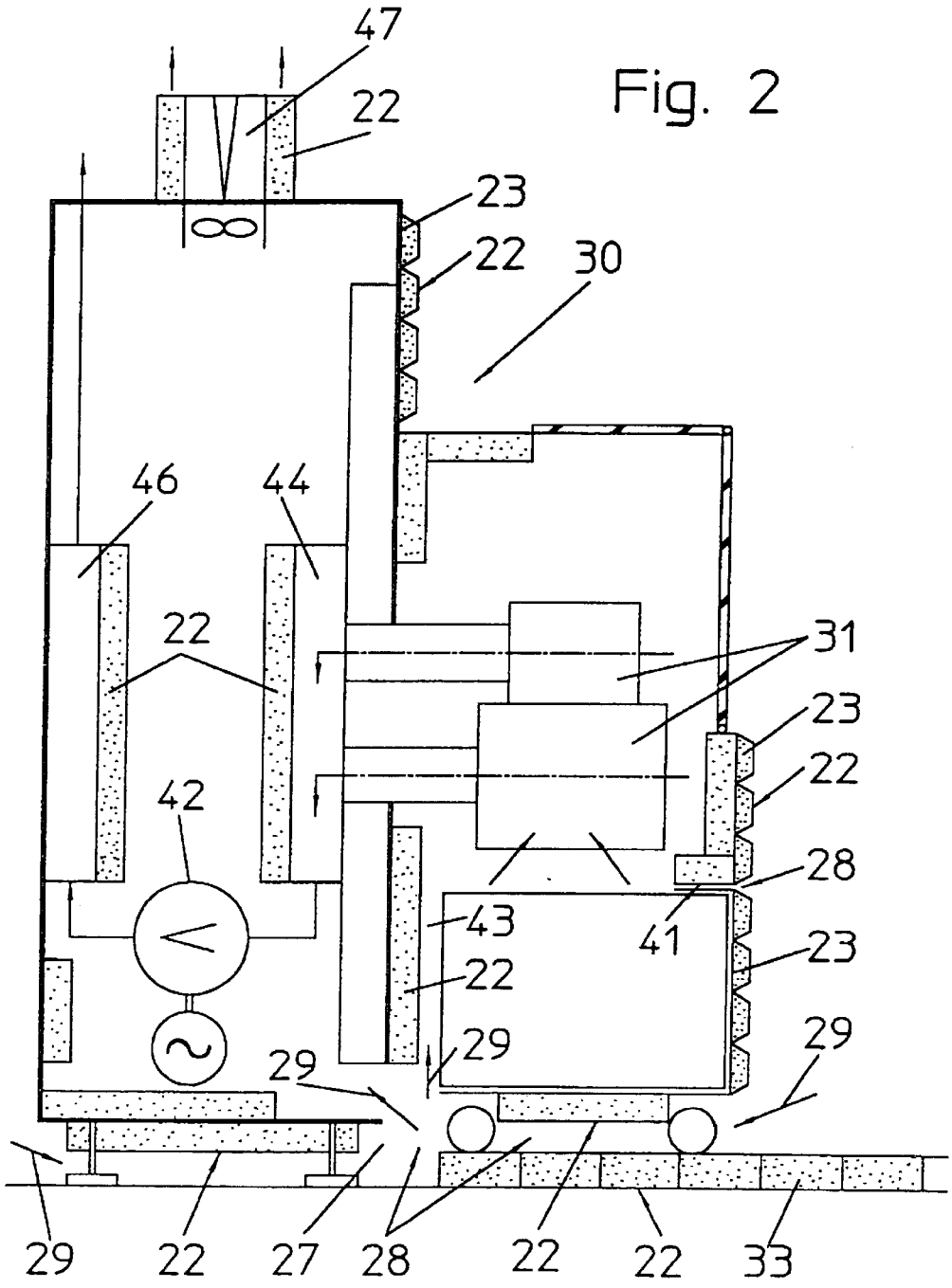
FIG. 2 is a sectional representation through a filter-attachment machine.

In the filter-attachment machine 30 shown in FIG. 2, which is likewise operated with a high air throughput for retaining rod-shaped tobacco articles in the cavities of conveyor drums 31, and for checking and separating out articles, damping mats 22 embodied in the same manner are mounted to the front and rear machine cladding, and on the machine floor, in the form of a sound damper 28 for a central air-intake opening 27.

In addition, a damping mat 22 is laid on the floor, at least from the standing region in front of the machine to beneath the machine floor.

Figure 4:
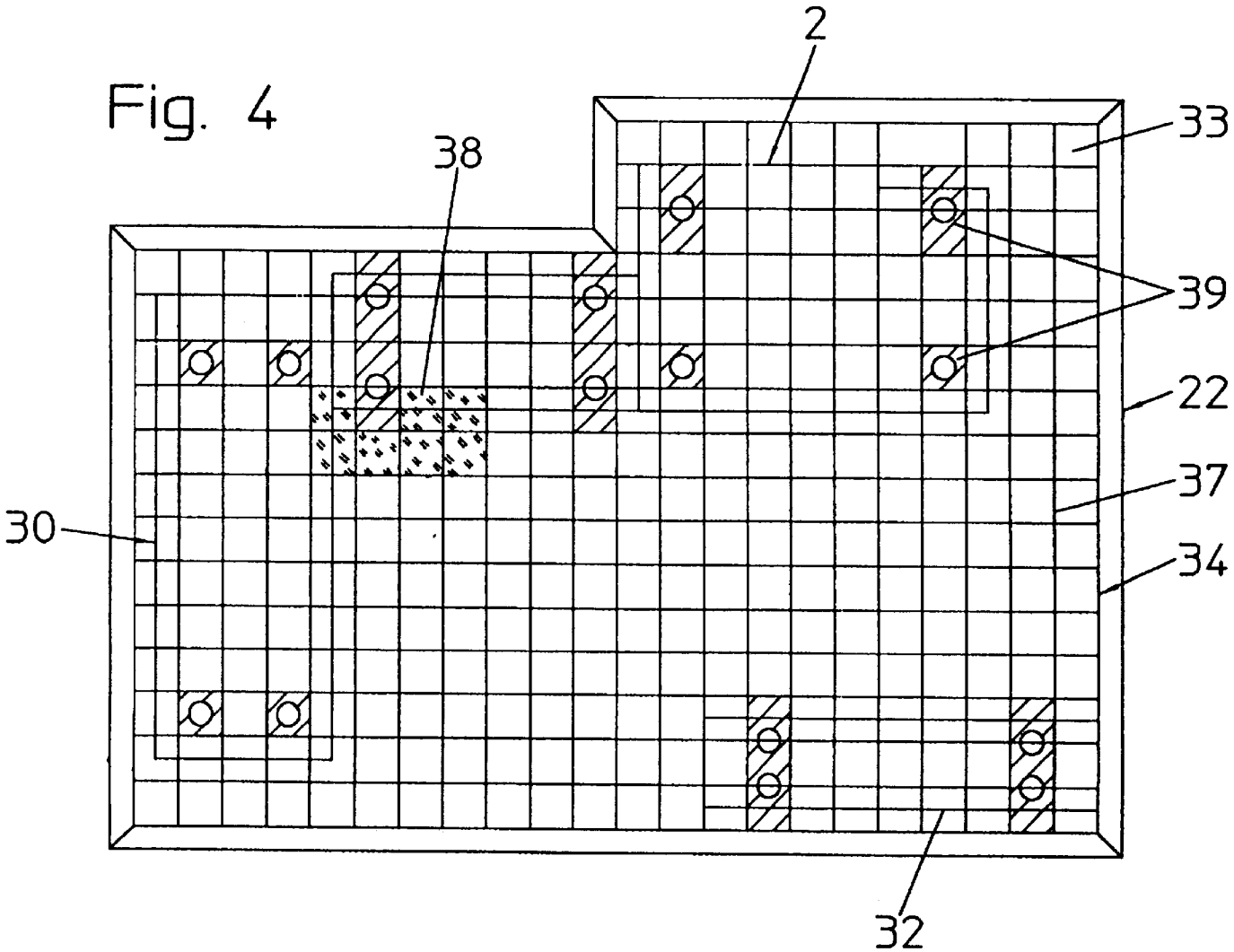
FIG. 4 a floor plan for sound-damping material for setting up the production line according to FIG. 3.
Figure 5:
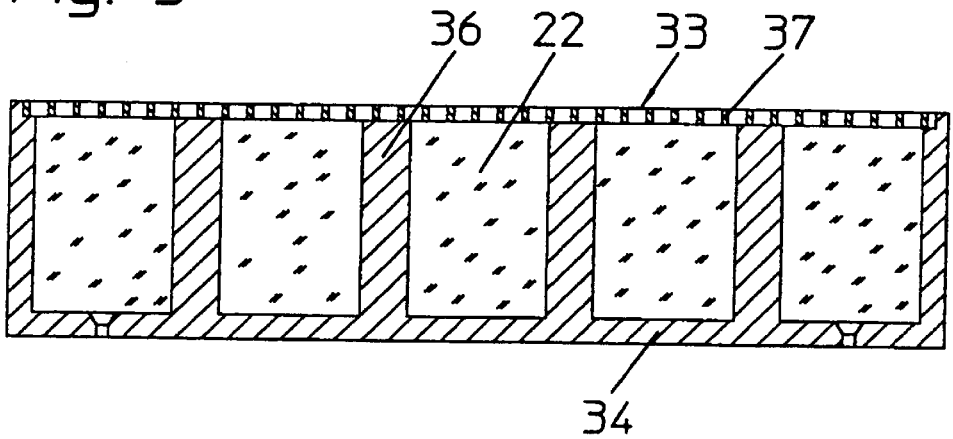
FIG. 5 a cross section through a tile element of the sound-damping material according to FIG. 4.
Figure 6:
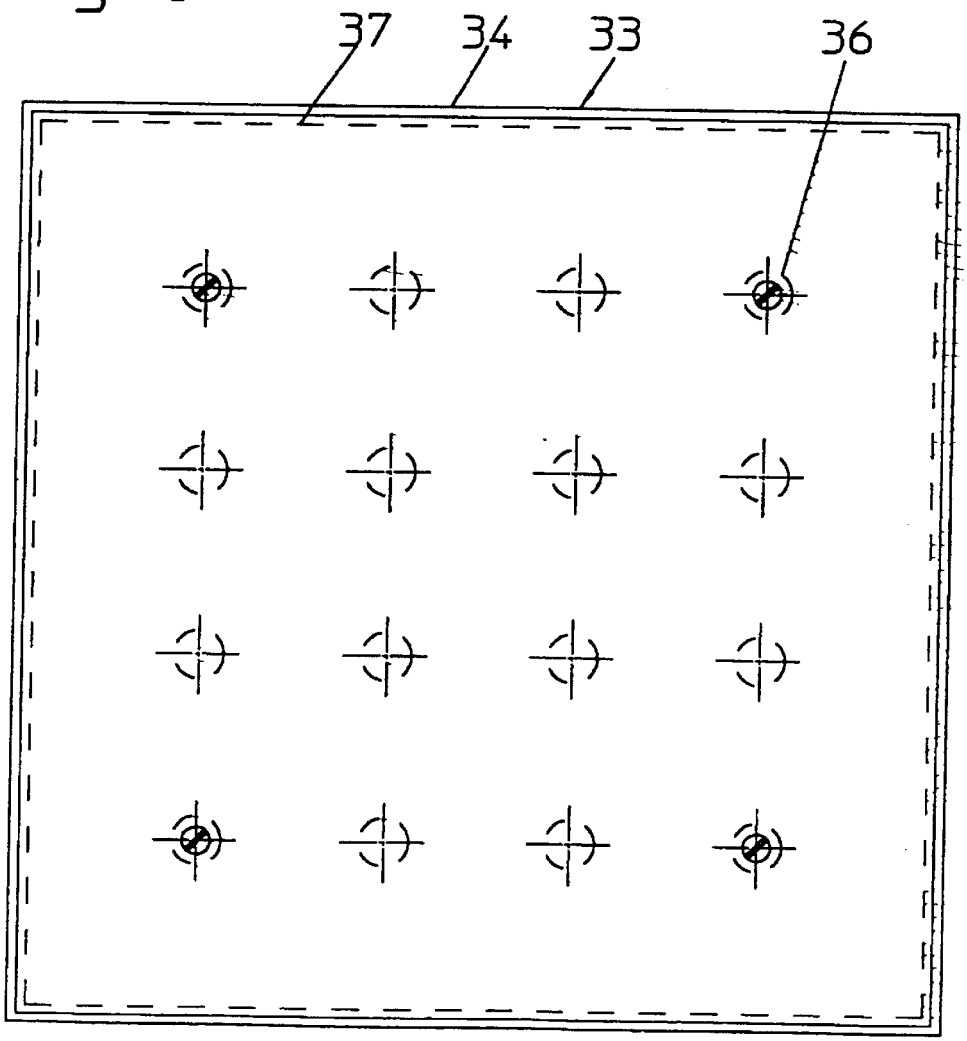
FIG. 6 a plan view of the tile element according to FIG. 5.

In the cigarette-strand machine 2 and filter-attachment machine 30 having a switch cabinet 32, and with the machines being set up at a closed right angle to form a production line 35 according to FIG. 3, the damping mat 22 is designed to cover the entire base surface of the production line 35 corresponding to FIG. 4. As the floor mat, the damping mat 22 comprises individual damping tiles 33, which, according to FIG. 5, are embodied as tile boxes 34 having supports 36 that are disposed in the manner of a grid, and are equipped with damping material in the form of damping mats 22 inserted with a precise fit. The tile boxes 34 as the standing surface are provided with a gridiron support 37 that is screwed to the supports 36.

Corresponding to the setup plan of the production line 35, stress-specific supports are inserted into the gridiron supports 37 according to FIG. 4, for example, at the locations with greater particle accumulation, in the form of easy-to-clean, closed plates 38, or under the machine bases in the form of reinforced support plates 39.

As a further anti-noise measure, according to FIG. 2, the remaining gaps 41 at the machines 2 and 30 are embodied to have the greatest possible sound-damping effect.

The air sucked in through a fan 42 is conveyed through sound-damped flow conduits 43, 44, 46 inside the machine, and carried off via an air exit 47 at the top of the machine, which further reinforces the sound damping.

In alternative embodiments of the damping elements illustrated in FIGS. 9 through 16, parts that correspond to those in the above-described arrangements are provided with reference numerals that are increased by one hundred.

Figure 10:
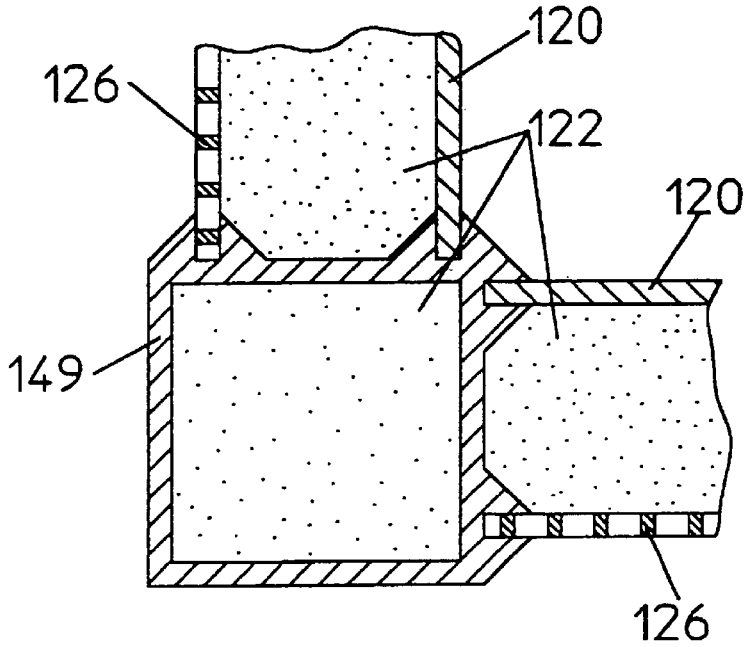
FIG. 10 a cross section through a corner profile strip of the carriage according to FIG. 9.
Figure 9:
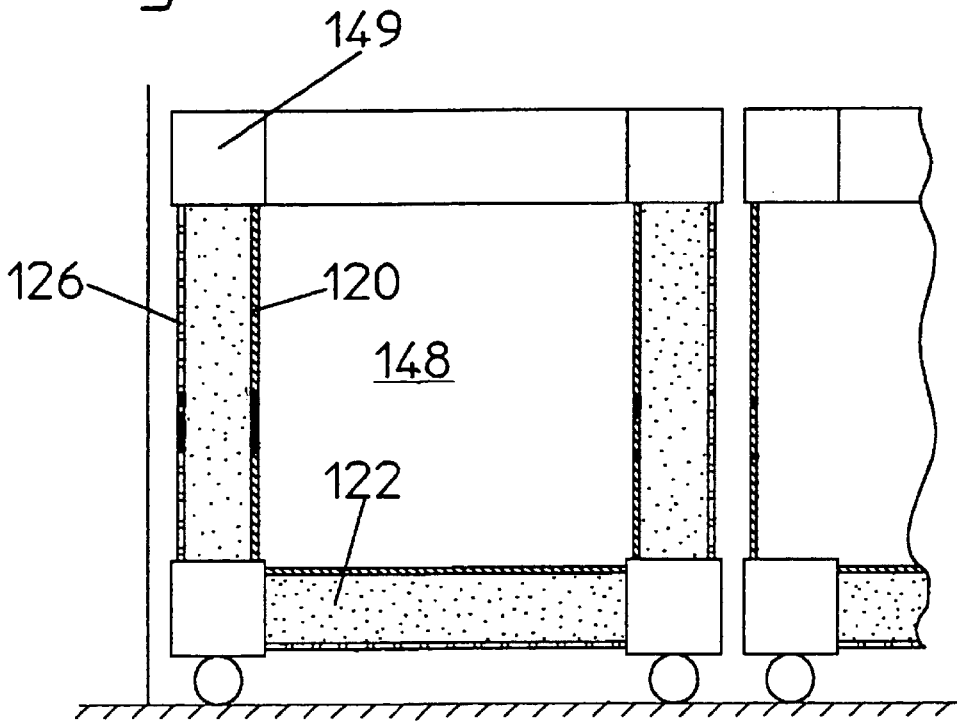
FIG. 9 an alternative damping cladding on a machine wall embodied as a removable carriage according to FIGS. 1 and 2.

In the carriages 148 illustrated on the outside of the machine in FIGS. 9 and 10, damping mats 122 are inserted laterally and underneath between inside reflection surfaces 120 and outside, sound-permeable cladding sheets 126, and into corner-profile strips 149, with the plate-shaped reflection surfaces 120 and cladding sheets 126 being inserted into the correspondingly-spaced receiving grooves of corner-profile strips 149.

Figure 11:
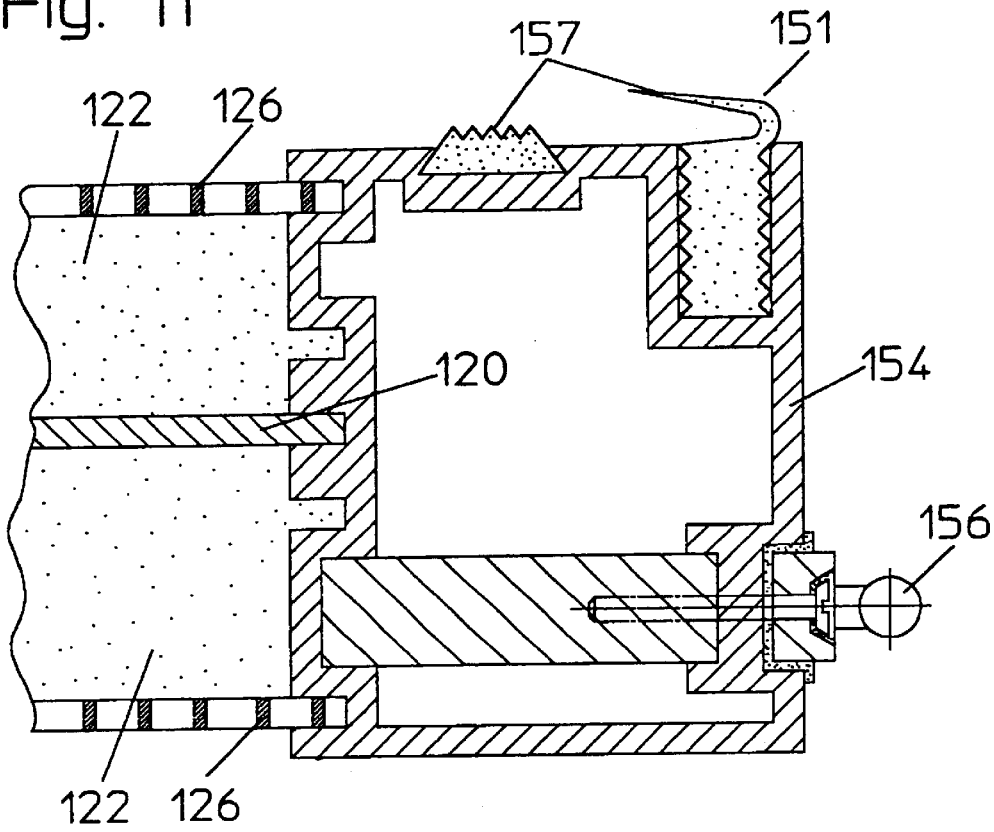
FIG. 11 a cross section through an alternative damping profile on a machine cladding embodied as a door.
Figure 12:
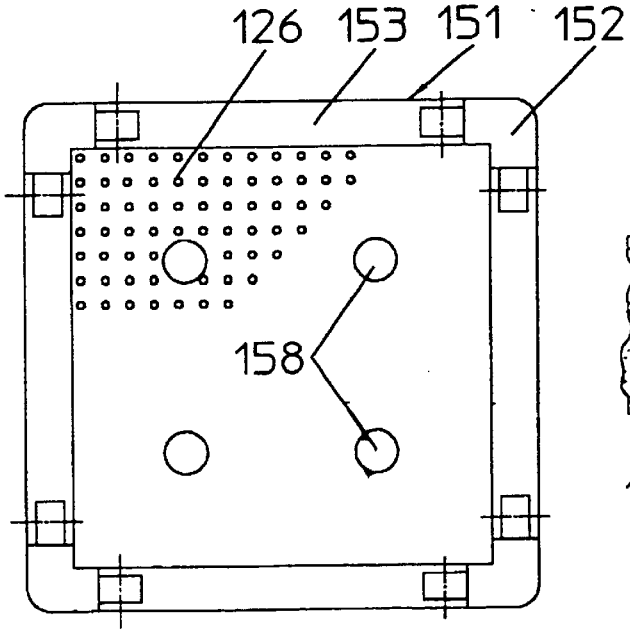
FIG. 12 a front view of the door according to FIG. 11.
Figure 13:
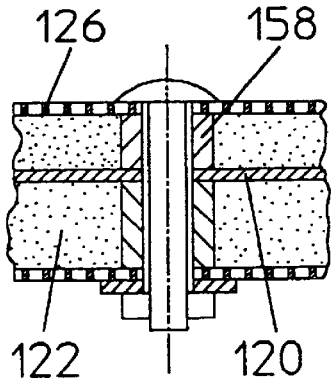
FIG. 13 a cross section through a detail of the door damping profile.

In the machine cladding embodied as a door 151 in FIGS. 11 through 13, inside and outside sound-permeable cladding sheets 126 with interposed reflection surfaces 120 are inserted into receiving grooves of four profile strips 154 joined by corner connectors 152 to form a profile frame 153. The hollow spaces formed in the process are filled with damping mats 122.

Sealing elements 157 are inserted into the profile frame 153, which can pivot about an axis 156. The cladding sheets 126 and the reflection surface 120 are stabilized against shifting by spacing sleeves 158 that are screwed together.

Figure 14:
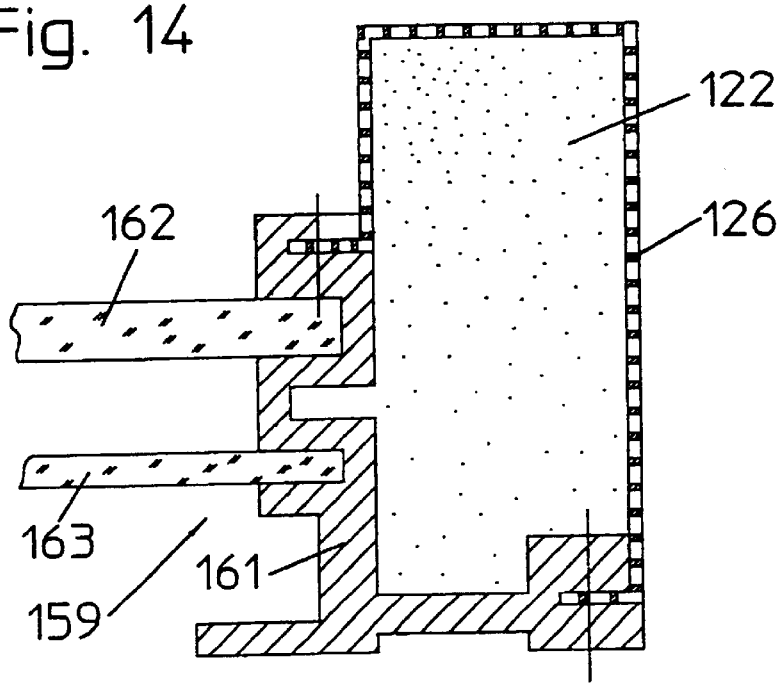
FIG. 14 a cross section through a damping profile of a machine cladding embodied as a see-through flap.
Figure 17:
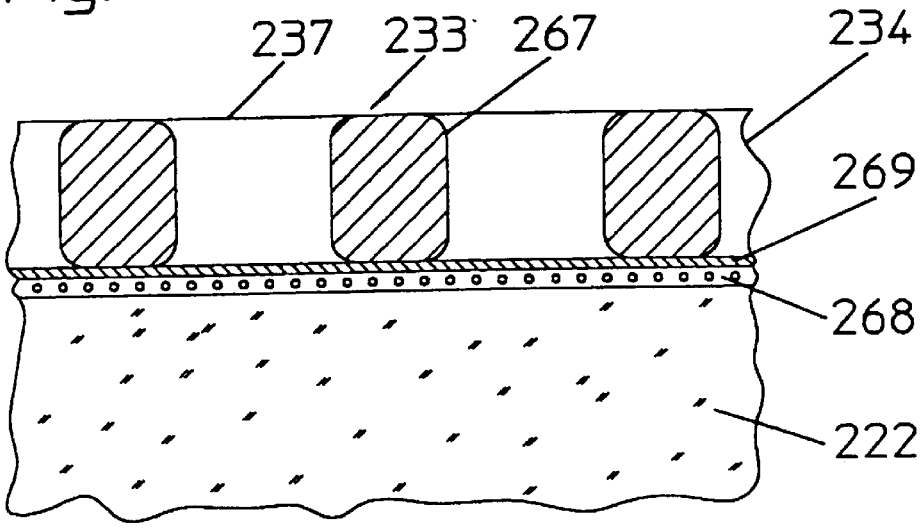
FIG. 17 a partial cross section through a further embodiment of the damping tile.

In the window flap 159 illustrated in FIG. 14, two viewing panes 162 and 163, and a cladding sheet 126, are inserted as a double glazing into a profile strip 161 of a window frame. The cladding sheet limits a hollow space that is filled with damping mats 122.

Figure 15:
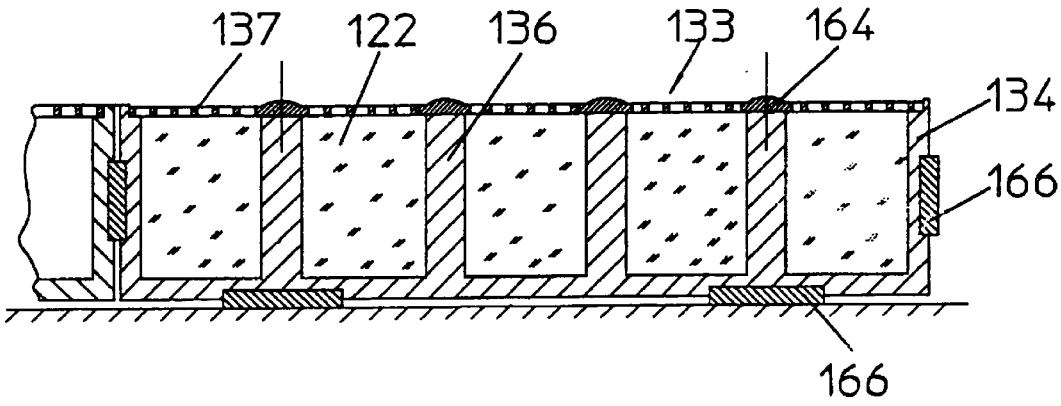
FIG. 15 a cross section through an alternative damping tile for covering the floor.
Figure 16:
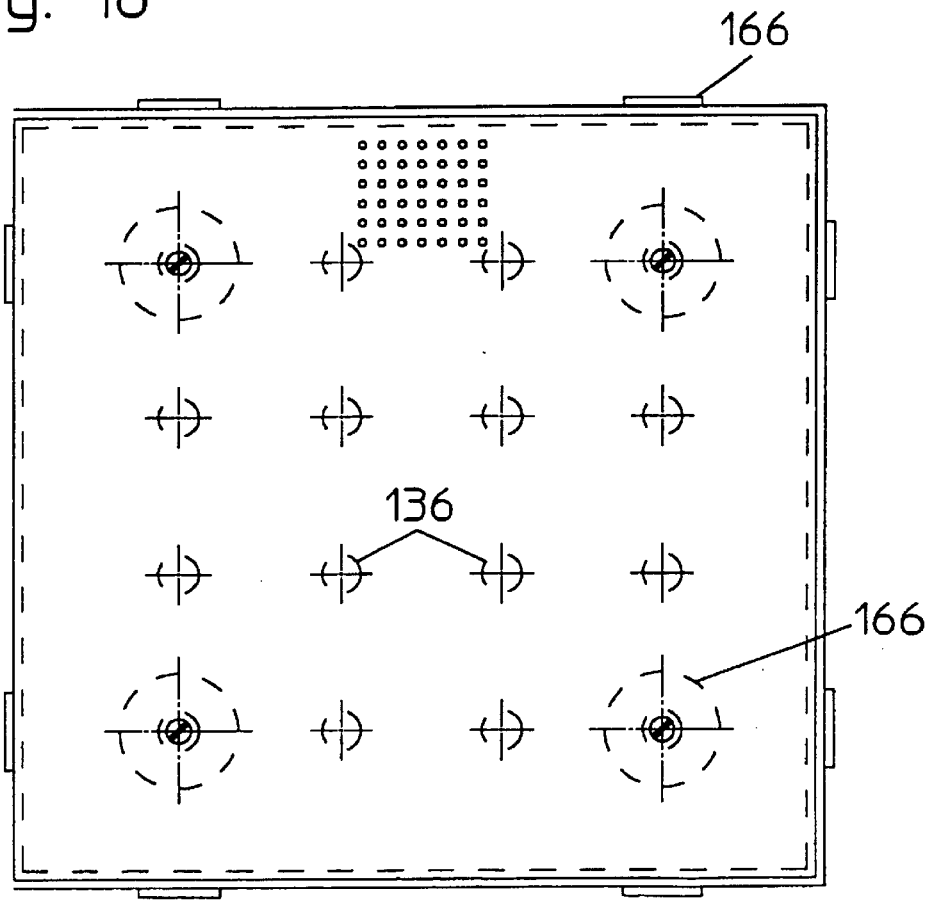
FIG. 16 a plan view of the damping tile according to FIG. 15.

In the alternative tile box 134 of a damping tile 133 covering the floor, as shown in FIGS. 15 and 16, the gridiron support 137 is provided with elevations 164 in a specific lattice or grid arrangement of the supports 136; these elevations prevent tobacco fibers that are lying on the gridiron support 137 from entering the damping mats 122, and allows them to be swept away more easily.

Furthermore, buffers 166, which prevent a solid-borne sound transmission between the damping tiles, and into the floor, are inserted, on the side and bottom, between the damping tiles 133.

As the last embodiment, in a floor-damping tile 233, a gridiron support 237 is provided with rounded edges 267 and a sound-permeable film 269, which is inserted between a narrow-mesh sieve 268 that lies on the damping mat 222 and the gridiron support 237, the film preventing the passage of fine particles into the damping material.

The invention has been described in detail with respect to preferred embodiments, and it will now be apparent from the foregoing to those skilled in the art, that changes and modifications may be made without departing from the invention in its broader aspects, and the invention, therefore, as defined in the appended claims, is intended to cover all such changes and modifications that fall within the true spirit of the invention.

What is claimed is:

1. An arrangement for reducing noise level in a control area of production machines in a tobacco-processing industry, comprising in combination;

at least two tobacco-processing production machines arranged at an angle to each other wherein the production machines have hollow wall element facing the control area, each said hollow wall elements having sieve perforated sheet metal panels facing the control area and reflection panels facing the respective production machine; and sound damping mats being arranged between the sieve perforated sheet metal panel and the reflection panel of each of the hollow wall elements.

2. The arrangement according to claim 1, wherein the at least two tobacco-processing production machines are limited by at least one personal standing region that is provided with a damping layer.

3. The arrangement according to claim 2, wherein the damping layer comprises exchangeable damping tiles that cover an entire surface beneath the production machines.

4. The arrangement according to claim 3, wherein the damping tiles comprise grid-type supports having tile boxes filled with damping material.

5. The arrangement according to claim 4, wherein the tile boxes include a gridiron support forming a standing surface.

6. The arrangement according to claim 5, wherein the damping tiles have stress-specific covers inserted into the gridiron support.

7. The arrangement according to claim 6, wherein the gridiron support of a tile box has rounded edges, the tile box includes a fine-mesh sieve positioned on the damping mat, a sound-permeable film that covers the fine-mesh sieve, and the gridiron support rests on the sound-permeable film.

8. The arrangement according to claim 4, wherein the tile box includes a gridiron support including elevations, and lateral and floor-side buffers.

9. The arrangement according to claim 1, wherein cladding forms the reflection panels.

10. The arrangement according to claim 9, wherein the damping mats comprises exchangeable damping elements.

11. The arrangement according to claim 10, wherein the damping elements comprise truncated cones connected to the machine cladding by a central screw connection.

12. The arrangement according to claim 11, wherein the truncated cones have absorption surfaces and the damping elements include cladding sheets having openings in the manner of a sieve covering the truncated cones.

13. The arrangement according to claim 1, wherein the production machine has air-flow cross sections for supplying process air and flow conduits, at least some of the flow conduits are clad with sound-damping material, and the air-flow cross sections are predominantly concentrated in the flow conduits clad with sound-damping material.

14. The arrangement according to claim 13, wherein the sound-damped flow conduits are concentrated in a floor region of the production machine.

15. The arrangement according to claim 13, wherein the production machine has cladding with air-passage gaps which are configured as sound-absorbing damping gaps.

16. The arrangement according to claim 1, wherein the production machine includes a removable carriage containing the hollow wall elements.

17. The arrangement according to claim 16, wherein the removable carriage includes a comer profile strip having a hollow space filled with damping material, and the reflection plates and the panels are insertable into the comer profile strips.

18. The arrangement according in claim 1, wherein the production machine includes a door having inside and outside cladding sheets with reflection surface interposed between the inside and outside cladding sheets defining hollow spaces between the reflection surface and a respective one of the inside and outside cladding sheets, and wherein the damping material comprises damping mats filling the hollow spaces, and the door further includes a profile frame comprising a hollow body having a pivoting axis and recessed sealing elements and the inside and outside cladding sheets are inserted into the profile frame.

19. The arrangement according to claim 18, further including spacing sleeves screwed together and stabilizing the cladding sheets and the reflection surface.

20. The arrangement according to claim 1, wherein the production machine includes a window flap comprising two viewing panes, a profile strip into which the viewing panes are inserted, and a cladding sheet inserted into the profile strip and limiting a hollow space filled with damping mats.

21. The arrangement according to claim 1, wherein the sound-damping mats are arranged such that noise from outside of the tobacco machine is absorbed.

22. The arrangement according to claim 1, wherein the sound-damping mats are arranged such that noise from outside of the tobacco production machine is at most only minimally reflected.

* * * * *